ST AVAILABLE COPY

US005489096A

United States Patent [19]

Aron

[11] Patent Number: 5,489,096

[45] Date of Patent: Feb. 6, 1996

[54] TICKET SYSTEMS FOR WAGERING ON SPORTS EVENTS

[75] Inventor: Charles M. Aron, Laramie, Wyo.

[73] Assignee: Double Win, Ltd., Laramie, Wyo.

[21] Appl. No.: 432,369

[22] Filed: Apr. 27, 1995

[51] Int. Cl.[6] ..... A63F 3/06; G07B 1/00

[52] U.S. Cl. ..... 273/138 R; 273/139; 283/903; 283/117; 283/67; 283/53

[58] Field of Search ..... 273/139, 138 R, 273/240; 40/53, 117, 903, 30, 60.1, 60.2, 49, 67, 901

[56] References Cited

U.S. PATENT DOCUMENTS

| | | | |
|---|---|---|---|
| 4,962,950 | 10/1990 | Champion | 283/67 |
| 5,043,889 | 8/1991 | Lucey | 273/138 A |
| 5,129,652 | 7/1992 | Wilkinson | 273/139 |
| 5,374,060 | 12/1994 | Goldberg | 273/139 |

OTHER PUBLICATIONS

Scarne's Complete Guide To Gambling by John Scarne, "Irish Hospitals' Sweepstakes Drawing", pp. 149–150, Simon and Schuster, 1961.

*Primary Examiner*—Benjamin H. Layno
*Attorney, Agent, or Firm*—Roland H. Shubert

[57] ABSTRACT

A method for enhancing the appeal of a sporting event at which wagering is allowed utilizes a dual-function ticket having two parts to produce a collectible souvenir having true rarity. A first ticket part records details of a placed bet, and is arranged to be cashed in to collect on a winning bet, while the second ticket part identifies the sports event and the participant on which the bet was placed, thereby serving as a souvenir having potential value as a collectible. Rarity of the souvenir ticket part is assured in that it can be obtained only through placing a bet, and the integrity of a collectibles aftermarket in the souvenir ticket parts is maintained by providing authentication means on the ticket to foil counterfeiting.

20 Claims, 4 Drawing Sheets

ST AVAILABLE COPY

ST AVAILABLE COPY

ST AVAILABLE COPY

ST AVAILABLE COPY

TICKET SYSTEMS FOR WAGERING ON SPORTS EVENTS

TECHNICAL FIELD

This invention relates generally to tickets for wagering on sports events and to methods for enhancing the appeal of such wagering.

In one specific embodiment of the invention, there is provided a pari-mutuel ticket that serves as a receipt for a wager, and serves as well as an event souvenir having the potential for enhanced value.

BACKGROUND ART

Organized wagering on sports events, pari-mutuel horse race betting for example, requires that a ticket be issued for each bet placed to serve as a receipt for the bet. The preparation and printing of pari-mutuel tickets to reflect the particulars of each wager made has become highly automated and computerized. A typical horse race pari-mutuel ticket contains information identifying the track at which the race was run, the date of the race, the number of the race, the number of the horse (or horses) upon which the bet was placed, the amount of the wager, the style of the bet (win, place, show, exacta, etc.), and authentication indicia such as serial numbers and the like. A winning ticket is surrendered in return for payment of the wager, while a losing ticket is usually discarded but is sometimes preserved for use as a tax record. After cashing in a winning ticket, the bettor has nothing to prove that he selected a particular winning horse running in a particular race. He is not able to both cash in the ticket and have proof that he bet on the winner.

An earlier approach to the preparation of tickets for pari-mutuel sports events is illustrated in U.S. Pat. No. 2,925,288. The focus of the invention described in that patent was to reduce the possibility of fraud on the part of handlers of ticket machines. The invention provides for a ticket strip pre-printed with sequential control numbers that are spaced so that at least one number will appear on each ticket that is printed. Test tickets from each ticket machine were printed at the end of each wagering session to determine the highest control number that could appear on any legitimate ticket. A ticket fraudulently printed after the event would then have a higher control number than any of the test tickets, allowing detection of the fraud when the ticket is presented for payment.

Operators of race tracks and other sports events at which pari-mutuel betting is offered often employ promotional activities, in addition to the attraction of wagering itself, to increase attendance and swell betting interest. Special forms of tickets have been proposed for such promotional purposes, and those tickets often allow admission to an event as well as providing a prize or specialized wager. One such strategy is described in U.S. Pat. No. 4,962,950, which provides an admission ticket that includes a pass stub used to gain entry into a pari-mutuel event, and a wagering stub that may be exchanged for a bet at the event in a preferred version, the ticket is printed on paperboard with the pass stub and the wagering stub separated along a perforation. A patron, to gain entry into the event, surrenders the pass portion of the ticket. He then exchanges the wagering stub for a bet that is defined by wager indicia printed on the stub.

An earlier version of a generally similar, dual function ticket is shown in U.S. Pat. No. 1,983,004. The ticket includes a pass stub that is separated from the body of the ticket upon entry into a race meet, and a prize coupon having indicia that is hidden from view until the pass stub is removed. Chance correlations between the coupon indicia and winners of selected races determines the award of prizes.

People who bet on sporting events generally like souvenirs of their successes. For example, each year thousands of winning pari-mutuel tickets are kept uncashed by horse racing fans because the fan is not able to cash the ticket and also have proof that he bet on the winner. Throughout the history of organized sports wagering there has never been a ticket system that allows a bettor to collect on a winning wager, and also to retain a souvenir record of a winning bet that identifies the sporting event and the winner thereof. This invention fills that need.

DISCLOSURE OF THE INVENTION

This invention provides a wagering system which uses a two-part ticket for recording bets on sports events to allow a bettor to both cash in a winning ticket, and to retain a souvenir record of the winning bet. A first ticket part is arranged to be cashed in to collect on the bet, and a second ticket part is retainable by the bettor. The first, or cash-in, ticket part need contain only that information carried on existing versions of pari-mutuel tickets, while the second, or souvenir record, ticket part identifies the sports event and the participant on which the wager was based.

Accordingly, it is an object of this invention to provide a wagering system for sports events.

Another object of this invention is to provide a dual-function ticket for use in betting on sports events that allows a successful bettor to both cash in a winning wager, and to retain a souvenir record of the winning bet.

Yet another object of this invention is to provide a method for enhancing the appeal of wagering on sports events.

Other objects and advantages of the invention will be apparent from the following detailed disclosure.

MODES FOR CARRYING OUT THE INVENTION

This invention in broad view provides a system for wagering on sports events such as athletic contests, tournaments, pari-mutuel horse racing, and other similar activities. It provides for a two-part ticket to be issued as a receipt for a wager placed by a bettor on a participant in the sporting event. The ticket is arranged so that one part may be cashed in to collect a winning wager, while the second part provides a souvenir receipt that documents the winning selection. Indicia on the second ticket part may include details of the bet as do the typical pari-mutuel tickets in use today. In addition, the second ticket part includes authentication indicia, defines the sports event, and identifies the participant on which the wager was placed. Thus, second ticket parts that are identified with a famous performer or historic sports event—particularly if the ticket represented a winning wager on that performer or event—have the potential for becoming valuable memorabilia. In contrast, the wagering systems of the prior art and currently in use do not have that capability or potential.

An embodiment of the invention which relates to pari-mutuel wagering on horse races will be described in detail, it being kept in mind that the invention is not limited to that embodiment but is broadly applicable to wagering systems for a great variety of sports events. Traditional pari-mutuel betting systems issue a ticket receipt for each separate bet that is placed. That receipt is cashed in to collect on a winning bet, leaving the bettor nothing but his winnings to document his bet. In order to have a souvenir to show for his wagering skills, he must forego collecting on his bet, and must as well correlate the winning ticket with the event through a race program or some other form of documentation.

Figure 1:
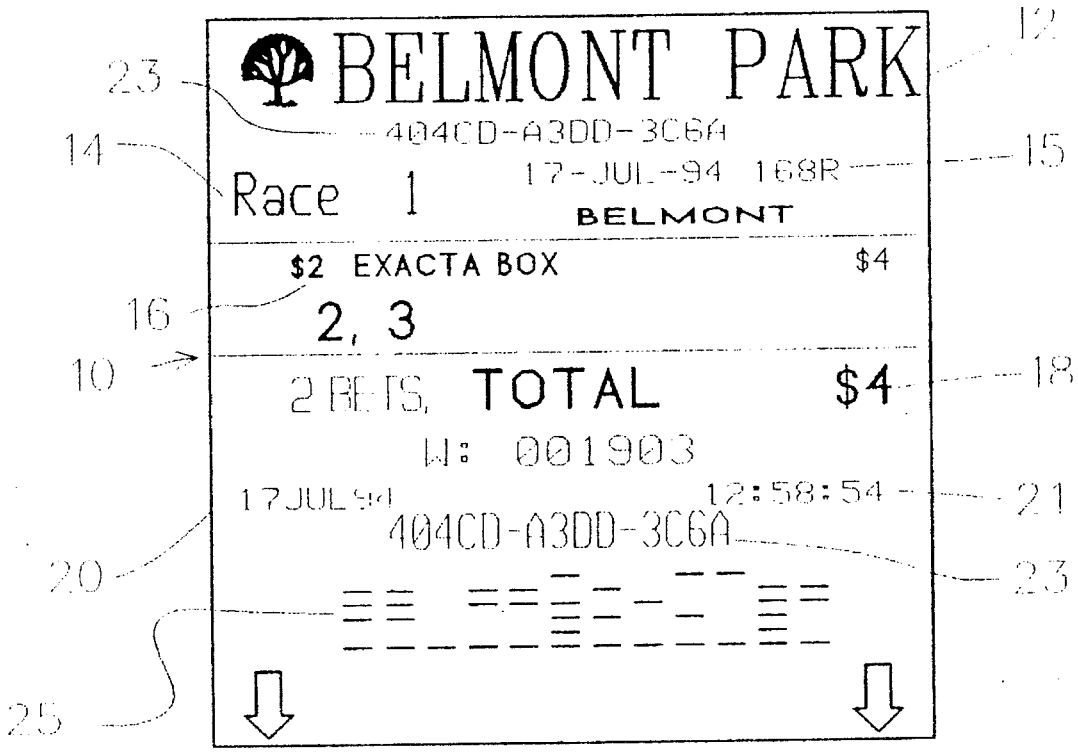
FIG. 1 replicates a pari-mutuel ticket that is generally representative of the prior art.

An example of a pari-mutuel ticket in current use is shown FIG. 1. That figure comprises the replication of a pari-mutuel ticket 10 that was obtained as a receipt for a wager placed on a horse race at Belmont Park. An identification of the racetrack 12 at which the bet was placed appears at the top of the ticket along with the number of the race 14, and the date of the race 15. Details of the wager, its form and amount, are recorded on the ticket at 16, with the total bet represented by the ticket set out at 18. The date and time that the ticket was purchased are registered at 20 and 21, respectively. A serial number 23 is inscribed on the ticket at two separate locations. Finally, machine readable data concerning the bet is imprinted on the ticket in bar code 25.

Figure 2:
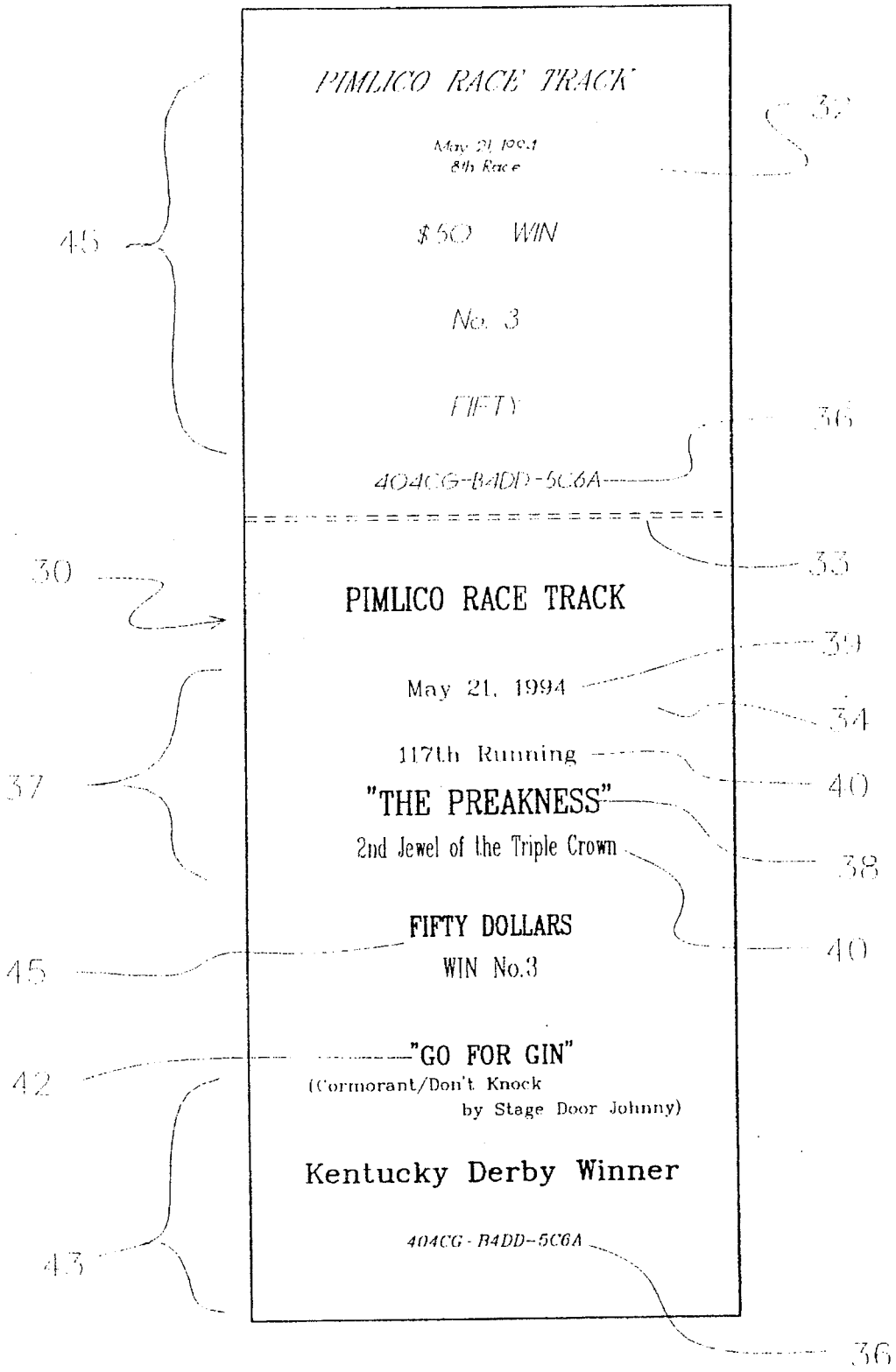
FIG. 2 depicts a two-part ticket arranged according to the teachings of this invention.

FIG. 2 depicts a ticket 30, arranged in accordance with this invention, as it might have been printed for a $50 win bet on "Go for Gin" in the 1994 running of the Preakness. The ticket itself is arranged in two parts, a cash-in part 32 and a take-home part 34. The two parts are formed of the same piece of sheet stock, suitably paper, and are joined together when issued. The two ticket parts are arranged so that one part can easily be severed from the other along perforation line 33. Cash-in part 32 of ticket 30 is the functional equivalent of the conventional pari-mutuel ticket shown in FIG. 1. It has imprinted thereon those details of the wager and other pertinent information ordinarily appearing on a conventional ticket. Take-home part 34 of ticket 30 may include part, or all, of the information set out in cash-in ticket part 32.

Certain other items must be imprinted on part 34 in order to obtain the advantages taught by this invention. Those other items necessarily include authentication indicia, a denotation or description of the sports event, and an identification of the participant or performer on whom the wager was placed. Authentication indicia suitably is imprinted on both ticket parts, and may comprise a serial number 36 or other unique marking. Instead of a serial number, a mathematical algorithm or other code that allows verification of the ticket's authenticity also find use. The serial number or other marking may comprise numbers, letters and combinations of numbers and letters, or may be imprinted on the ticket in the form of a bar code, magnetic characters, or other machine readable indicia.

A description 37 of the sports event includes sufficient details to identify the event with singularity. That description may include, for example, the name of the event 38, the date of the event 39, and other descriptive material 40. The identification of the participant or performer may simply be a name or designation 42, and may include additional descriptive material 43 that is unique to the named participant. Such descriptive material, may in the case of horse racing for example, comprise information as to the pedigree of the horse on whom the wager was placed. A designation 45 of the wager placed may be imprinted on the take-home part 34 of the ticket as well as on the cash-in part 32.

Presuming that ticket 30 represented a winning bet, cash-in part 32 would be severed from take-home part 34 along perforation line 33. Part 32 would then be surrendered in return for payment of the wager in the same manner as is now practiced with the conventional pari-mutuel ticket. Take-home ticket part 34 would then be a souvenir of the sports event, documenting the placing, and collection, of a winning bet.

The take-home ticket part from a winning wager would not only be a desirable souvenir, it would have true rarity as well. That is because the number of units existent would be equal to and limited by the number of individual bets placed on the winning entity. Hence, there would exist the potential for creating a legitimate—rather than contrived—aftermarket of the ticket parts as a valuable collectible. Whether it be coins, postage stamps, or baseball cards, the value of a collectible is set primarily by its rarity. Value or price of a collectible is almost without exception inversely proportional to the quantity available.

Historically, there have been only two ways that rarity has been created in legitimate collectible markets. The first way is by limiting production, and the second is through accident. Fine art generally is an illustration of value created by limiting production. For example, there ordinarily exists a sharp gradation in price or value between an artist's oil painting (limited by its nature to only one); a signed, numbered print by the same artist (expressly limited to a small number, often in the range of 50 to 500); and an unsigned, unlimited edition of a print (possibly the same image as the signed lithograph) by the same artist. The value assigned by the market to the works of a well known artist might be in the range of $200,000 for the oil painting, $20,000 for the signed, numbered lithograph, and $20 for the unsigned mass production print.

The second way in which valuable rarity in collectibles has developed is through accident. A mis-printed postage stamp or a mis-struck coin are examples. Another accidental way in which rarity develops is through the disappearance of most items through indifference over decades of time. The Rogers Hornsby baseball card, certain old stamps, even particular old cars, are examples of that happening. Even though quite a few of the cards, the stamps, and the cars may have been manufactured, most ended up in someone's trash or junk, simply because they were not considered to be valuable at the time they were discarded.

when speaking of collectibles, as the term is used in this disclosure, a distinction is made between the legitimate collectibles market described above, and a second, created or contrived market. That contrived market comprises the deliberate, large volume production of items that designated as "collectibles" at the time of sale. Such items, "new issue" postage stamps and mass produced baseball cards for example, are unlikely to ever have any real value.

In contrast to the contrived collectibles market, the ticket of this invention produces a keepsake having legitimate and genuine rarity. There are a number of reasons for that result. First, the ticket is ancillary to a bet, and it is the bet that must be paid for, not the ticket. Also, as the denomination of the bet increases, the ticket rarity increases as well. By limiting the issuance of tickets to the larger denomination bets, $10 and up for example as is contemplated in one preferred embodiment of this invention, rarity can be further enhanced. At the time of purchasing a ticket, a bettor will have no way of knowing how many others are doing the same. Many fewer tickets will be sold for long-shots, for example, than for favorites. The degree of rarity of an individual ticket thus depends in large part upon chance.

With many ordinary collectibles, there is the ever present problem of counterfeiting. The ticket of this invention is far less vulnerable to counterfeiting efforts than are most other collectibles. Bets (and ticket sales) close when the gates for a race open, and there is a clear and public record of the amount bet on each race. Even though the number of tickets purchased will vary from race to race, the total number of tickets for any particular event will be known. The use of serial numbers or other authentication indicia provides a protection not provided by most other collectibles as a chain of ownership can be traced by the serial number.

An absorbing possibility offered by the ticket of this invention is that a ticket's future value may be affected and enhanced by the results of subsequent races or other sports events. There are many illustrations that might be drawn from horse racing to illustrate such possibilities. For example, had the ticket of this invention been in use in past races, there would have been many people with a ticket on Secretariat when he won the Belmont Stakes. But many fewer would have purchased, and preserved, a win ticket on his loss at the Wood Memorial in his last race before the Kentucky Derby. Yet, as a collectible, the Wood Memorial ticket might be valued more highly than would be the Belmont Stakes ticket. A losing win ticket, or a winning place ticket, on Alydar losing the three triple crown races might well have been assigned a higher value than the winning tickets on Affirmed in the same races. Sea Hero was beaten in many races before he won the Derby. His Derby win would have exerted a powerful influence on the value of tickets on his previous races.

Another prospect offered by the this invention is in the potential for creating sets of tickets. Examples of such ticket sets might include: all of Secretariat's wins; all of the winners (Onion among others) who beat Secretariat; the three horses that placed in the three Triple Crown races in one particular year; winners of a particular race, such as the Travers Stakes, over a ten year period; all five winners of Woody Stevens' unequalled streak of consecutive Belmont's; and the winners of all seven Breeders' Cup races in a given year. The possibilities are endless, and are of the sort to create a fanatical aftermarket much as that which exists for autographs of famous people.

As was illustrated and described in the discussion of the FIG. 2 embodiment, information as to the pedigree of the horse upon which the wager is placed may advantageously be included on take-home ticket part 34. Such information will appeal to the more dedicated race fan as it will aid the collection of ticket parts representing a family of winners. Examples may include winners sired by a particular stallion, and successive generations of winners such as the six-generation sequence of Polynesian/Native Dancer/Raise a Native/Mr. Prospector/Fappiano/Cryptoclearance/Strategic Maneuver. An inviting aspect of collections based upon pedigree is that a horse generation represents a relatively short time. That, in turn, creates the potential for a ticket aftermarket based upon pedigree to quickly develop.

Figure 3:
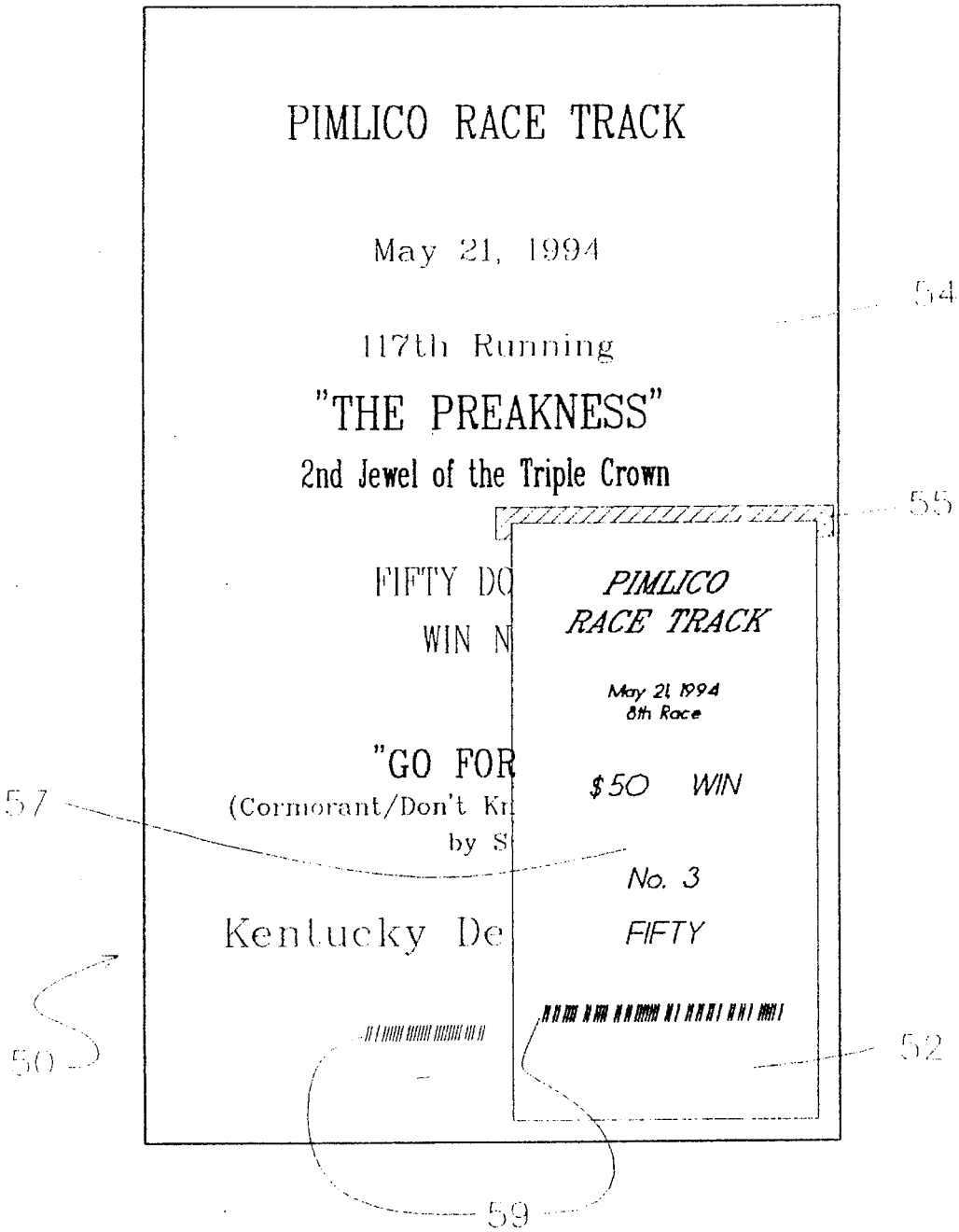
FIG. 3 is another embodiment of the ticket of FIG. 2.
Figure 4:
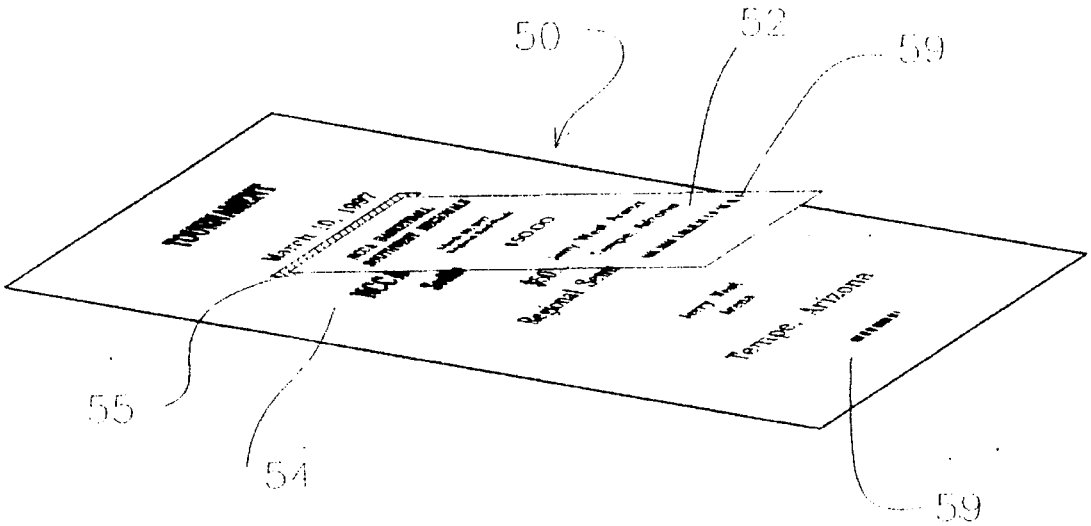
FIG. 4 shows details and variations of the FIG. 3 ticket.

FIG. 3 illustrates another embodiment of the ticket shown in FIG. 2, while FIG. 4 shows details and variations of the FIG. 3 ticket. Referring now to both FIGS. 3 and 4, ticket 50 includes two parts, a cash-in part 52 and a take-home part 54. The two ticket parts are physically associated together by a joining means, which may be an adhesive strip 55. Take-home ticket part 54 is equivalent to, and may be the same as ticket part 34 of FIG. 2. Likewise, cash-in ticket part 52 is the functional equivalent of a conventional pari-mutuel ticket as is shown in FIG. 1, and may be the same as ticket part 32 of FIG. 2.

As before, ticket part 52 is imprinted with details of the wager on the face thereof at 57. Both ticket parts also are provided with authentication indicia 59 which may comprise a serial number (FIG. 3) or machine readable symbols such as a bar code (FIG. 4). While the cash-in ticket part 52 has been illustrated as carrying a different suite of information than does take-home part 54, the two ticket parts may be the same in content. In fact, one ticket part may be a photocopy, or other faithful reproduction, of the other. In that event, one ticket part may be of a different physical size than the other in order to define which part is honored when it is presented to cash in a winning bet.

The tickets of this invention may be manufactured upon demand using a computer-driven printing means that is arranged to accept a bet from a customer, and to print out a ticket detailing the bet. The entire ticket may be printed in this fashion on suitably perforated stock forms to produce the ticket embodiment of FIG. 2. A similar technique may be used to produce the ticket embodiments of FIGS. 3 and 4, but those last embodiments also offer additional printing options. For example, the take-home ticket part 54 may be pre-printed, leaving only the cash-in portion 52 to be printed and issued upon placement of a bet. In that case, the two ticket parts are adhesively joined, or otherwise associated together, as the ticket is issued to the bettor.

The embodiment of this invention in which the take-home part of the ticket is pre-printed lends itself especially well for wagering on sports events other than pari-mutuel horse racing. The name of the participants in many sports events, the World Series, Super Bowl, the basketball Final Four as examples, are scheduled many days to even weeks in advance, while horse race entries ordinarily are not final until Thursday before a Saturday race. Thus, the scheduling of many sports events allows a generous time for pre-printing the take-home ticket parts.

As may be readily appreciated, use of the tickets of this invention enhances the appeal of attendance at sports events of all kinds, and promotes a continued and growing interest in such events. Legitimate rarity of the souvenir record provided by the take-home ticket part is assured because it can be obtained only by the placing of a bet, and because successful counterfeiting is essentially precluded through the authentication procedures provided.

While preferred embodiments of the invention have been presented for purposes of illustration and description, that disclosure is not intended to be exhaustive, nor to limit the invention to the precise forms disclosed. Other variations and modifications to the invention will be apparent to those skilled in the art after study of the foregoing disclosure.

The embodiments of the invention in which exclusive rights are asserted are set out in the following claims.

I claim:

1. A system for wagering on a sports event comprising means to accept a bet from a bettor and to issue in return a two-part ticket as a receipt for the bet, a first part of said two-part ticket recording details of the bet, and arranged to be cashed in to collect on a winning bet, and the other part of said two-part ticket arranged to be retained by the bettor as a souvenir receipt documenting the bet, and identifying the sports event and the participant upon which the bet was placed, both said ticket parts carrying authentication indicia, the two ticket parts associated together when issued, and arranged to be separated one from the other when said first ticket part is cashed in to collect on a winning bet.

2. The system of claim 1 wherein said authentication indicia comprises machine readable symbols imprinted on the ticket.

3. The system of claim 2 wherein said imprinted symbols comprise a serial number.

4. The system of claim 1 in which the sports event is a pari-mutuel horse race.

5. The system of claim 4 wherein details of the bet placed are recorded on both ticket parts, and wherein identification of said sports event includes the number of the race.

6. The system of claim 5 wherein the identification of the participant on which the bet was placed comprises the name of the horse, and includes information as to the pedigree of said horse.

7. The system of claim 1 wherein said ticket is formed from a single piece of sheet stock, said sheet arranged with a perforation line between the ticket parts to thereby allow the first ticket part to be removed and cashed in to collect on a winning bet.

8. The system of claim 1 wherein the ticket parts are formed from separate pieces of sheet stock, and wherein the two parts are joined at the time the ticket is issued as a receipt for a bet.

9. A method for enhancing the appeal of a sports event by creating a collectible souvenir having true rarity comprising:

providing a wagering system that allows attendees at said event to place bets on selected participants in said event;

issuing a two-part ticket as a receipt for a placed bet, a first part of said ticket arranged to be cashed in to collect on a winning bet, and a second part of said ticket arranged to be retained by the better as a souvenir receipt of the winning wager;

providing indicia on said ticket to verify its authenticity;

providing indicia on said second ticket part that identifies the sports event and the participant upon which the bet was placed; and limiting the number of said souvenir receipts that are created to equal the number of bets placed.

10. The method of claim 9 wherein said sports event is a peri-mutuel horse race.

11. The method of claim 10 wherein details of the bet placed are recorded on both ticket parts, and wherein identification of said sports event includes the number of the race.

12. The method of claim 11 wherein the identification of the participant on which the bet was placed comprises the name of the horse, and includes information as to the pedigree of said horse.

13. The method of claim 9 wherein said ticket is formed from a single piece of sheet stock, said sheet arranged with a perforation line between the ticket parts to thereby allow the first ticket part to be removed and cashed in to collect on a winning bet.

14. The method of claim 9 wherein the ticket parts are formed from separate pieces of sheet stock, and wherein the two parts are joined at the time the ticket is issued as a receipt for a bet.

15. The method of claim 9 wherein said indicia for verifying the authenticity of the ticket includes machine readable symbols imprinted on the ticket.

16. The method of claim 15 wherein said machine readable symbols comprise a serial number.

17. The method of claim 9 wherein the rarity of said collectible souvenir is enhanced by limiting the issuance of said two-part tickets to large denomination bets.

18. A dual-function ticket to record a wager placed on a sports event and to provide a collectible souvenir of true rarity, comprising:

a first ticket part arranged to record a bet and adapted to be cashed in to collect on a winning bet;

a second ticket part identifying the sports event and the participant upon which the bet was placed, said first and second ticket parts associated together when the ticket is issued to record said wager but severable to allow said first ticket part to be cashed in, said second ticket part arranged to be retained by a bettor as a souvenir of the event; and indicia on said ticket for determining its authenticity.

19. The ticket of claim 18 wherein the indicia for determining the authenticity of the ticket includes machine readable symbols imprinted on both ticket parts and wherein said symbols include a serial number or mathematical code that allows verification of the ticket's authenticity.

20. The ticket of claim 19 wherein the sports event is a pari-mutuel horse race, wherein details of the bet placed are recorded on both ticket parts, and wherein the identification of the participant includes the name of the horse upon which the bet was placed and its pedigree.

* * * * *